US009572472B2

(12) United States Patent
Fodrocy

(10) Patent No.: US 9,572,472 B2
(45) Date of Patent: Feb. 21, 2017

(54) CLEANING DEVICE FOR USE WITH DISPOSABLE CLEANING ELEMENTS

(71) Applicant: Geerpres, Inc., Muskegon, MI (US)

(72) Inventor: Joseph J. Fodrocy, Muskegon, MI (US)

(73) Assignee: Geerpres, Inc., Muskegon, MI (US)

( * ) Notice: Subject to any disclaimer, the term of this patent is extended or adjusted under 35 U.S.C. 154(b) by 105 days.

(21) Appl. No.: 14/495,516

(22) Filed: Sep. 24, 2014

(65) Prior Publication Data

US 2016/0081527 A1 Mar. 24, 2016

(51) Int. Cl.
*A47L 13/254* (2006.01)
*A47L 13/44* (2006.01)

(52) U.S. Cl.
CPC ..... *A47L 13/254* (2013.01); *A47L 13/44* (2013.01)

(58) Field of Classification Search
CPC ..... A47L 13/10; A47L 13/20; A47L 13/44; A47L 13/254; A47L 13/256; A47L 13/257; A47L 13/258
USPC ..... 15/231, 228
See application file for complete search history.

(56) References Cited

U.S. PATENT DOCUMENTS 1,469,568 A 10/1923 Williams
3,546,754 A 12/1970 Erb
3,708,833 A 1/1973 Ribich
3,775,802 A * 12/1973 Grassman ..... A47L 13/254 15/147.2
3,778,860 A * 12/1973 Thielen ..... B25G 3/38 15/144.2
3,899,803 A 8/1975 Brumlik
4,332,454 A 6/1982 Hensel
4,455,705 A 6/1984 Graham
5,067,210 A 11/1991 Keyaki
5,382,462 A 1/1995 Pacione
7,530,139 B2 5/2009 Niemeyer
7,690,069 B2 4/2010 Chen
2003/0044569 A1 3/2003 Kacher
2011/0185529 A1* 8/2011 Kandasamy ..... A47L 13/10 15/209.1
2011/0203607 A1* 8/2011 Slavin ..... A45D 34/041 132/320
2012/0151703 A1 6/2012 Chow
2013/0340187 A1 12/2013 Bober

OTHER PUBLICATIONS

Rubbermaid Reveal, 3 photos.

* cited by examiner

*Primary Examiner* — Laura C Guidotti
(74) *Attorney, Agent, or Firm* — Mitchell Intellectual Property Law, PLLC

(57) ABSTRACT

A cleaning device is provided to which an easily removable and replaceable cleaning element can be attached. The cleaning device comprises an applicator head having a top side and a bottom side and defining holes there through which are sufficient in size and number that cleaning liquid collecting on the top side readily flows through the applicator head The applicator head also includes a handle mount attached to the top side of said applicator head for pivotally attaching a handle and a plurality of spaced-apart hooks extending from the bottom side of said applicator head and placed around the peripheral edge of said holes, said hooks comprising a shaft with a bard extending from the end of said shaft said barb facing in and extending over the adjacent hole.

30 Claims, 6 Drawing Sheets

CLEANING DEVICE FOR USE WITH DISPOSABLE CLEANING ELEMENTS

FIELD OF THE INVENTION

The present invention relates to a cleaning device for use with removable and replaceable cleaning elements, such as a mop sponge, dusting cloth, polishing pad or the like.

BACKGROUND OF THE INVENTION

Various types of cleaning devices with removable, and replaceable cleaning elements, such as a sponge, mop, dusting pad or the like for use with or without liquid cleaning solutions have been suggested. These devices suggest use of solid plate like rectangular holders having an attachable handle and means for securing a cleaning element to the holder. The means for securing the cleaning element to the holder can be spikes or double hooks, adhesives or the like. Adhesive backed strips of Velcro™ hook fasteners have been adhered to the holder, as have such strips of hook fasteners attached with adhesive of mechanically. Such attached fasteners require frequent replacement. The holder can be formed of a molded plastic with the spikes or hooks molded with the rectangular holder. In these previous cleaning devices the holder is usually formed of a solid sheet of plastic material having a handle mount part on the top face for attaching as handle and the spikes or hooks extend from the bottom for holding the removable cleaning element.

SUMMARY OF THE INVENTION

The present invention is a cleaning device comprising an applicator head having a top side and a bottom side, and including a plurality of holes there through which are sufficient in size and number that cleaning liquid collecting on the top side readily flows through the applicator head back into an attached cleaning element. A plurality of spaced-apart hooks are positioned around the peripheral edge of each said holes, extending from the bottom side of said applicator head and each comprising a shaft with a barb extending from the end of said shaft said bath facing in and extending beneath its adjacent hole, whereby an applicator can be releasable attached by said hooks to said applicator head.

Because of the plurality of holes through the applicator head excess liquid does not collect on the applicator head and hence does not splash off the top of the applicator head and onto a surface previously cleaned, and the location and orientation of the hooks facilitate integral molding of the applicator head in a two piece mold with no secondary mechanical action.

BRIEF DESCRIPTION OF THE DRAWINGS

Other objects and advantages will appear as the description proceeds, as well as from the appended drawings in which.

DETAILED DESCRIPTION OF THE PREFERRED EMBODIMENTS

Figure 1:
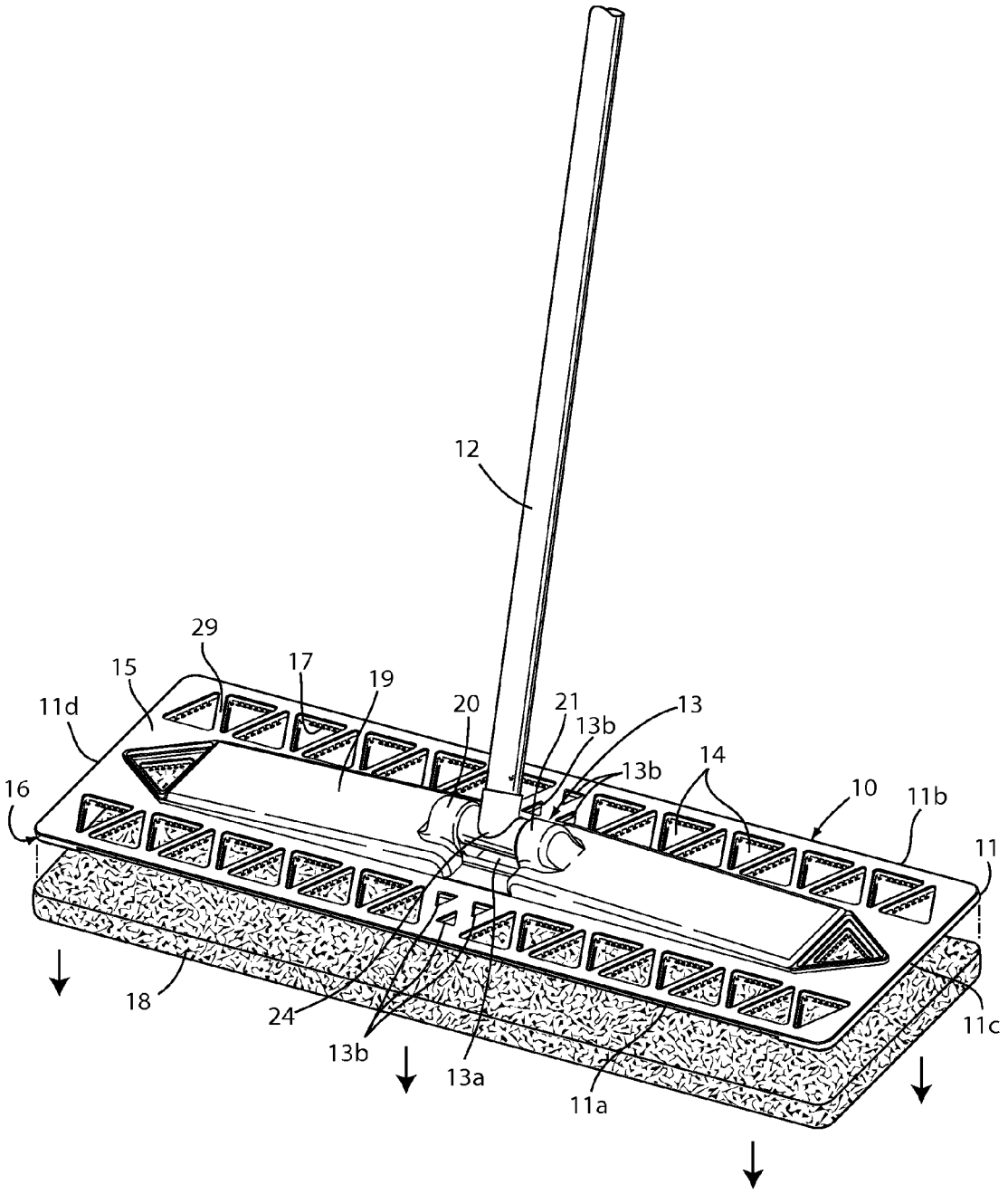
FIG. 1 is an isometric view of the present cleaning device with the applicator head being connected to a handle and including a cleaning element is position to be attached.

The cleaning device 10 of the preferred embodiment includes a one piece molded plastic applicator head 11 which is generally planar in shape, including opposed respective top and bottom sides 15 and 16. Head 11 includes handle mount 11 to which a handle 12 is attached, drain hole openings 13*a*, 13*b* and which allow water to drain of the top 15 of head 11 and into a cleaning element 18 (rather than running of onto previously cleaned floor), and downwardly depending hooks 17 adjacent holes 14, for attaching cleaning element 18 to applicator head 11. Releasably mounted cleaning element 18 is of the same configuration as the bottom side 16 of the applicator head 11.

The numbers in the Figures and used in the specification identify the following items or features:

10-Cleaning device
11-Applicator head
11*a*-Leading perimeter edge
11*b*-Trailing perimeter edge
11*c*- and 11*d*-End perimeter edges
12-Handle
13-Handle mount
13*a*-Drain hole passing through applicator head 11, below handle mount 13
13*b*-Drain holes fore and aft of handle mount 13
14-Drain holes passing through applicator head 11
15-Top side of applicator head 11
16-Bottom side of applicator head 11
17-Hooks aligned along periphery of holes 14
18-Cleaning element
19-Reinforcement rib

20, 21-Arms of handle mount 13 extending upward from reinforcement rib 19

22, 23-Pegs extending from each arm, 20 and 21

24-Tubular cross member

25-Shaft of hook 17

26-Barb of hook 17

Figure 9:
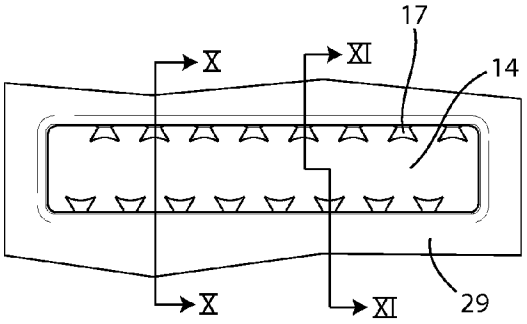
FIG. 9 is an enlarged view of a portion of the embodiment of FIGS. 7 and 8 illustrating one rectangular opening and the location of the hooks around the peripheral edge of the rectangular opening.

27-Cross section portion of a two piece mold through section XI-XI of FIG. 9 for manufacturing an applicator head 11 defining rectangular holes showing a portion of the applicator head in the mold and hooks 17 extending from the bottom of the applicator head.

Figure 12:
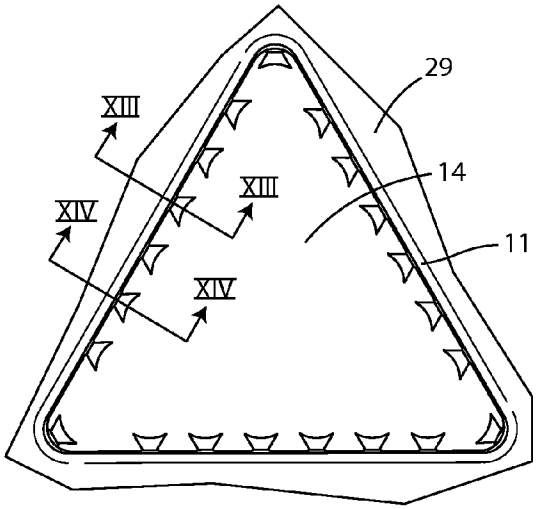
FIG. 12 is an enlarged view of a portion the embodiment of the invention illustrated in FIGS. 1-3 illustrating one triangular opening and the location of the hooks around the peripheral edge of the triangular opening.

28-Cross section portion of a two a piece mold through section XIV-XIV of FIG. 12 for manufacturing an applicator head 11 defining triangular holes showing a portion of the applicator bead in the mold and hooks extending from the bottom of the applicator head.

29-Bridges formed in applicator head and defining holes 14.

30 and 31-Faces of the arms 20 and 21 of the handle mount 13.

32 Lip extending downward around the perimeter edge of the applicator head 11.

The applicator head 11 is shown as rectangular in shape and includes holes 14 there through located along the leading and trailing perimeter edges 11*a* and 11*b* of head 11. There are two additional holes 14, one located at each end of the applicator head, near end edges 11*c* and 11*d*. Bridges 29 between said holes 14 define the size and shape of the holes 14. Each hole is sufficiently large to allow cleaning solution to drain through it readily, and sufficiently small to avoid unduly weakening applicator head 11.

The leading and trailing edges of applicator head 11 are so named since they are the leading and trailing edges of applicator head 11 as it is pushed forwardly. Preferably, holes 14 are located at least along the leading and trailing edges of said applicator head 11. Cleaning solution collecting, on the upper surface of applicator head 11 will tend to flow toward edges 11*a* and 11*b* as the head is pushed and pulled over the floor. The proximity of holes 14 to leading and trailing edges 11*a* and 11*b* will capture the solution before it has a chance to run off applicator head 11 over the leading or trailing edges 11*a* and 11*b*. If holes 14 were located further back from the leading and trailing edges 11*a* and 11*b*, solution could collect in the space between holes 14 and edge 11*a* or 11*b*, and then run over edge 11*a* or 11*b* without being Intercepted by holes 14. There is a drain hole 13*a* located in the center of applicator head 11, below handle mount 13, and there are three small triangular shaped drain holes 13*b* located in the fore-aft direction relative to handle mount 13. Drain hole 13*a* facilitates central drainage, and holes 13*b* facilitate peripheral edge portion drainage in the middle of the length of applicator head 11. Unlike drain holes 14, holes 13*a* and 13*b* do not include associated hooks 17.

Rather than place holes 14 throughout applicator head 11, reinforcing ribs 19 free of holes extend over the center portion of the top side 15 of applicator head 11, between the rows of holes 14 along the leading and trailing edges 11*a* and 11*b*. Ribs 19 provide strength and rigidity to the applicator head 11.

Figure 11:
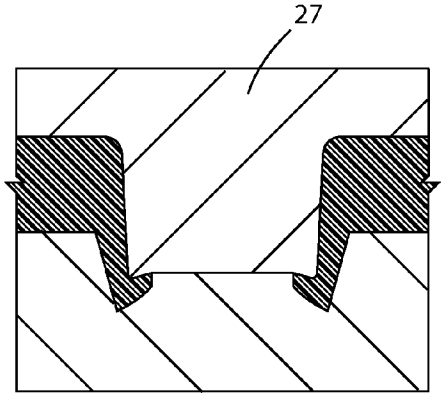
FIG. 11 is a section view through line XI-XI as it would look inside a two piece mold used to manufacture the applicator head by injection molding of a thermoplastic resin.
Figure 10:
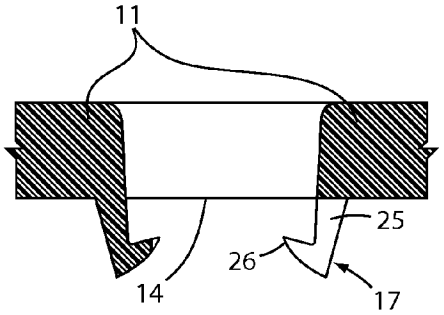
FIG. 10 is a section view through line X-X of FIG. 9.
Figure 14:
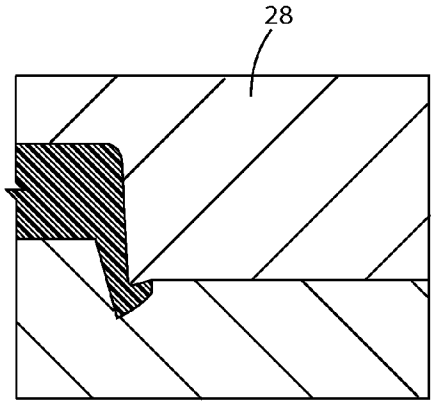
FIG. 14 is a section view through line XIV-XIV as it would look inside a two piece mold used to manufacture the applicator head by molding of a thermoplastic resin.
Figure 13:
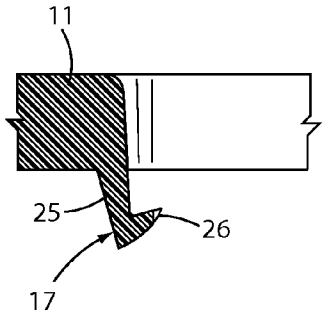
FIG. 13 is a section view through line XIII-XIII of FIG. 12.

Hooks 17 are positioned along the peripheral, edges of the holes 14, and extend downward from the plane of applicator head 11. Hooks 17 comprise a shaft 25 and a barb 26. The barb 26 preferably faces in the direction of and extends under the opening of holes 14. This design permits using two piece molds as shown in FIGS. 11 and 14 in molding applicator head 11. A sufficient number of hooks 17 are provided to assure a secure but releasable mounting of a cleaning element 18 to the bottom side of the applicator head 10.

Hooks 17 preferably are integrally molded with the applicator head 11. An enlarged view of the hooks showing the barbs 26 on the end of the shafts 25 are illustrated in FIGS. 6, 9 and 12 through 14. The Figures illustrate double barbs but single barbs are also useful. The angle of the barb to the shaft can range over a wide range provided they are effective to engage a removable clearing element 18. Preferably the barb extends from the shaft at an angle of less than about 90 degrees. The hooks are sufficiently long to securely hold a cleaning element but not penetrate through the cleaning element to extend through the other side. Hooks ranging in length from about 0.04 to about 0.25 inch, preferably from about 0.06 to about 0.13 inch, most preferably about 0.90-0.92.

The distance between adjacent hooks 17 can vary but range from one half to about one and one half the length of the hooks Preferably, hooks 17 are spaced from about 0.06 to about 0.35 inch apart, more preferably from about 0.12 to about 0.25 inch apart. Preferably there are from about 14-24 hooks around the perimeter of each hole 14. There are 21 hooks 17 around the perimeter of each triangular shaped hole (six on a side and one in each corner), and 16 hooks around the perimeter of each rectangular shaped hole (8 on each side), as shown in the preferred embodiments.

Preferably, holes 14 and their associated hooks 17 occupy from about 15 to about 50 percent of the area of the underside of applicator head 11, more preferably from about 25 to about 30 percent of the area. As noted above, it is preferable that most of the holes be located adjacent and extending away from the leading and trailing edges 11*a* and 11*b* of applicator head 11. When so placed the area of the holes 14 occupy from about 80 to about 95 percent of the peripheral area where they are located, preferably more than 90 percent of the peripheral area of the applicator head. Some holes may optionally be located at the end portions or even in the central portions of applicator head 11, in order to provide drainage and hooks in that area. However, it is most preferable that the central area of applicator head 11 be free of holes in order to rigidify applicator bead 11. The central area of applicator head which is free or substantially free of holes may however contain holes that account for about 10 to about 25 percent of that area.

Figure 4:
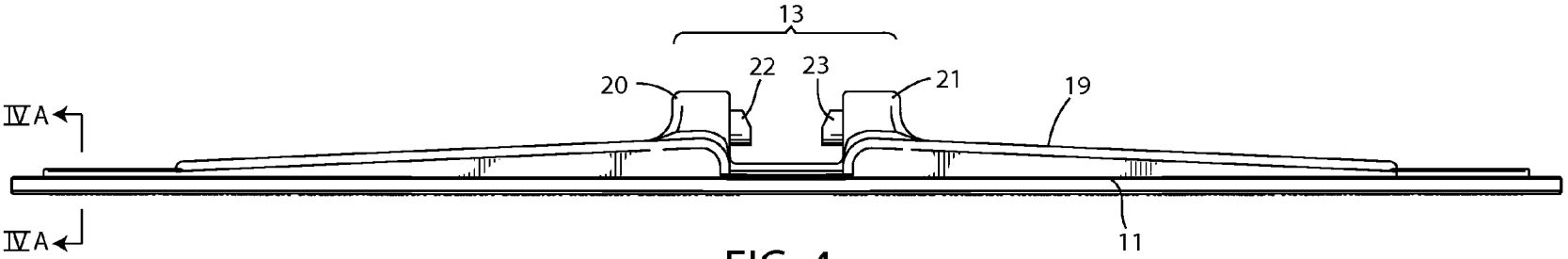
FIG. 4 is a side view of the applicator head of FIG. 1.
Figure 4A:
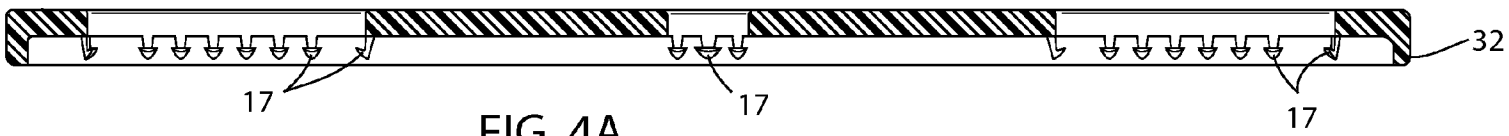
FIG. 4A is a section view through line IVA-IVA of FIG. 2 and FIG. 4.
Figure 6:
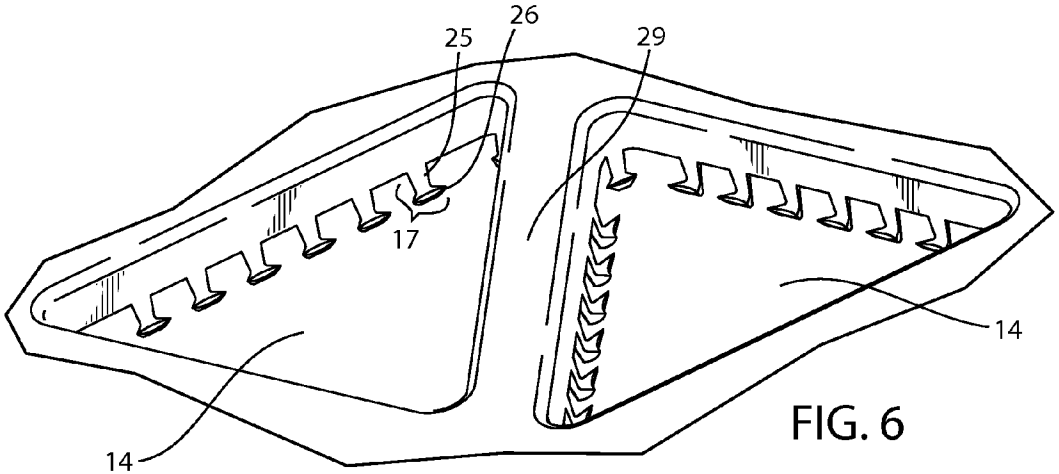
FIG. 6 is an enlarged fragmentary isometric view of a small area of the applicator head showing two of the triangular holes and showing the hooks projecting downward around the peripheral edge of the triangular holes with their barbs facing inwardly into the space below the holes.
Figure 5:
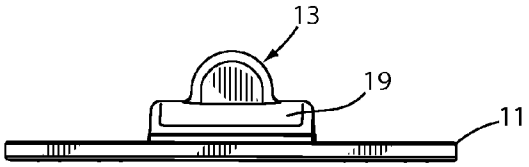
FIG. 5 is an end view of the applicator head of FIG. 1.

FIG. 4A illustrates an embodiment of the invention wherein a lip 32 extends downward around the perimeter edge of the applicator head 11. The downward length of the lip is slightly greater than the length of hooks 17 which also extend downward. Lip 32 helps keep the cleaning element 18 from shifting about as the mop is used, thereby minimizing flexing stress on hooks 17. Lip 32 also protects hooks 17 from excessive impact, and provides reinforcing strength to head 11.

FIG. 9 illustrates the embodiment where the hooks facing across the hole 14 from each other are staggered and not directly in line across from each other. This is a preferred embodiment since it allows for different pattern and fabric direction of cleaning elements 18. Other orientations are also useful.

The applicator head 11 is designed to be used with well-known fibrous or spongy cleaning elements 18 that can be secured to and released from the applicator head 11 though engagement with the hooks. When the inner surface of the cleaning element 18 is pressed against the bottom side 16 of the applicator head 11, the hooks 17 penetrate the cleaning element 18 and the barbs 26 engage and become entangled with the fibrous or spongy material of the cleaning element 18. The cleaning element 18 may be easily removed from the applicator head 11 by applying outward stripping action to the cleaning element 18.

Figure 7:
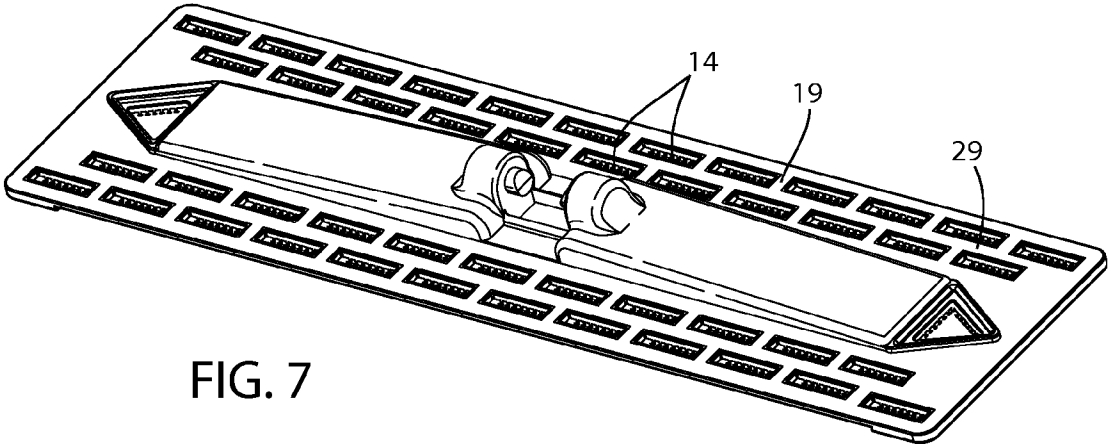
FIG. 7 and FIG. 8 illustrate an embodiment of the applicator head in isometric and top view having the holes defined in a rectangular shape.
Figure 8:
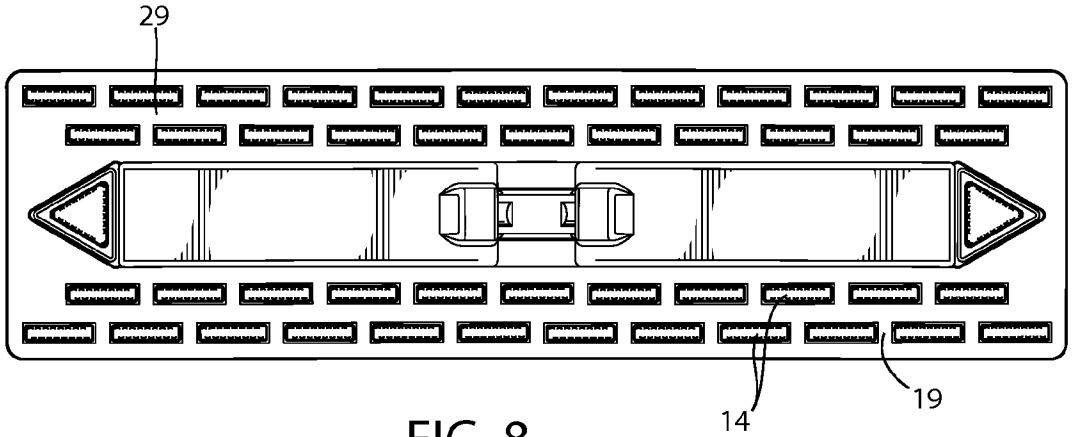

The Figures illustrate two hole configurations, equilateral triangles and rectangular. Both can be used in the same applicator head as shown in FIGS. 7 and 8. Other hole shapes such as oval, round, square can be used or combinations thereof.

Figure 2:
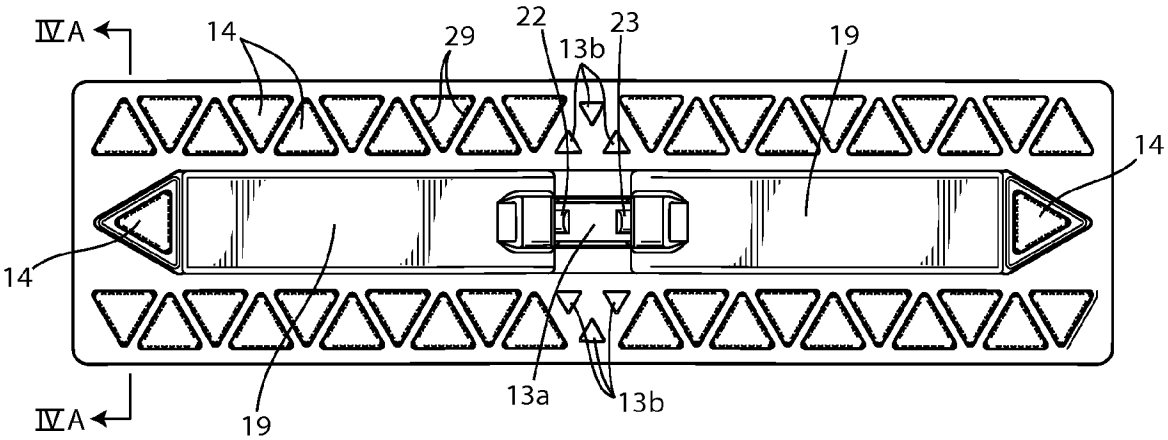
FIG. 2 is a top view of the applicator head of FIG. 1.
Figure 3:
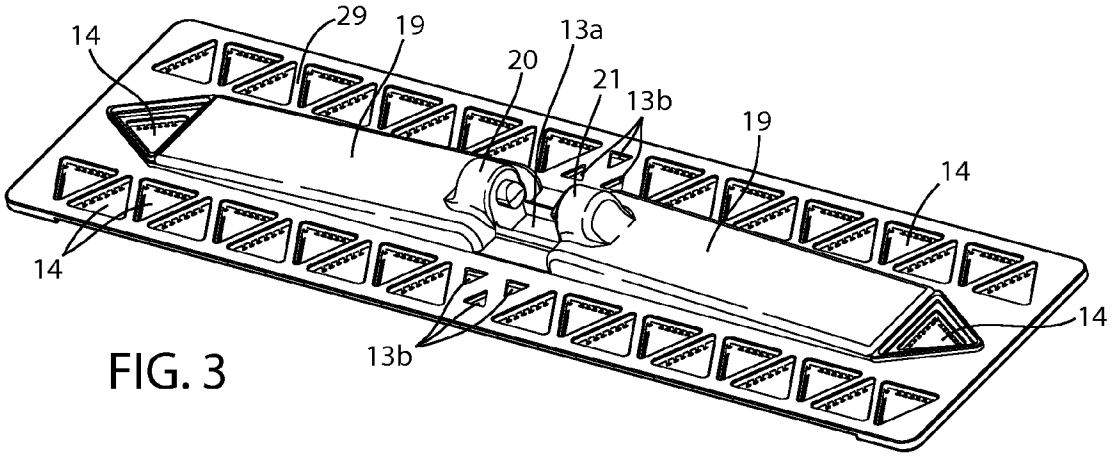
FIG. 3 is an isometric view of the applicator head of FIG. 1 illustrating in more detail the location of the hooks extending downwardly from the perimeter of triangular holes through the applicator head.

The triangular hole is preferred since they surprisingly provide an applicator head having good strength and rigidity. FIGS. 1-3 illustrate a preferred arrangement of holes. In this embodiment triangular holes are arranged in a single lattice row along both long sides (leading and trailing edges 11*a* and 11*b*) of the rectangular application head in a flip flop, or alternating adjacent orientation to each other supported and defined by the bridges 29 and body of the applicator head. By flip flopped or alternating adjacent orientation, we are referring to the fact that the apexes of adjacent triangles point in opposite directions relative to the leading or trailing edges 11*a* or 11*b* of attachment head 11. This orientation minimizes the ability of cleaning solution to slosh off of cleaning head 11 and over edge 11*a* or 11*b*, by passing between adjacent holes 14, since the motion of solution gathering on top of attachment head 11 will tend to be fore and aft in the direction in which the cleaning device is moved, and the bridges between adjacent triangular openings are oriented at an acute angle to the fore and aft direction of motion of from about 30-60 degrees, depending on the configuration of the triangle. Preferably, the triangular shape of holes 14 is equilateral in configuration, such that the angle of orientation of bridges 29 is about 45 degrees to the fore and aft direction of motion. The embodiment also contains a single triangular hole at each end of the applicator head.

In the rectangular hole embodiment of FIGS. 7 and 8, two rows of holes are provided along each leading and trailing peripheral edges 11*a* and 11*b*. Further, the holes 14 in the two rows are staggered relative to one another, so that as with the flip flopped triangles, solution will not tend to flow over the leading or trailing edge 11*a* or 11*b* by passing between adjacent holes 14. However as noted above, the same effect is accomplished using a single row of larger triangular shaped holes 14, of alternating adjacent orientation.

The dimensions each individual hole 14 can vary and for e ample the open area of each can range from about 0.35 to about 0.60 square inch, preferably from about 0.40 to about 0.55 square inch. The area of each triangular hole 14 is about 0.52 square inch and each rectangular hole is about 0.52 square inch.

Figure 15:
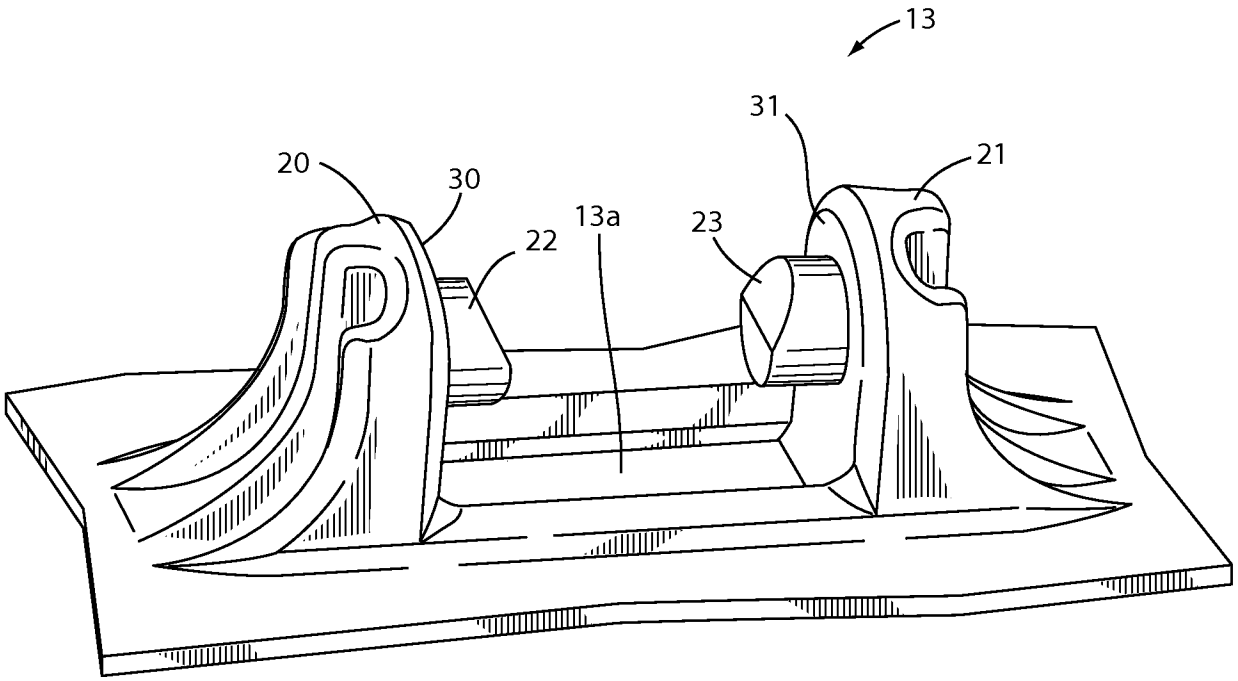
FIG. 15 is an enlarged view of the handle mount 13 portion of the applicator head. In the drawings like parts or features are not always numbered but are readily apparent.

A handle mount 13 is centrally attached to the top side 15 of the applicator head 11 for pivot mount of a handle 12. This allows manipulating the applicator head 11 in a cleaning motion over a surface to be cleaned. The handle mount 13 as illustrated is attached to the reinforcement rib 19. An enlarged view of the handle mount used in this embodiment is shown in FIG. 15. The handle mount 13 comprises two arms 70 and 71 extending above the top plane of the top side 15 of the applicator head 11. Extending from the face (30, 31) of each arm and facing each other are round pegs 22 and 23 aligned on the same axis. The axis of the round pegs is substantially parallel to the plane of the top side 15 of the applicator head 11. A gap is provided between the faces of the round pegs to permit engagement with and securing the handle 12 to the applicator head 11. In the illustrated embodiment one end of a handle 12 is fitted with a tubular "T" shaped cross member 24 functionally adapted to engage with the round pegs in a manner to allow the handle to pivot back and forth in a plane essentially perpendicular to the axis of the round pegs. The inside diameter of the tubular cross member 24 greater than the outside diameter of the outside diameter of the pegs to permit easy movement back and forth. The length of the T portion of the cross member is less than the distance between the faces (30, 31) of the arms 20 and 21. Other types of handle mounts 12, for example, ball and socket joints, can attach a handle to the applicator head. The handle mount can also be provided with pivot stops to limit the pivot distance of the handle in relation to the applicator head. Preferably the handle mount is integrally molded with the applicator head but can be separately manufactured and attached to the top side of the applicator head.

It will be noted that handle 12 can be pivoted toward either edge 11*a* or 11*b* of applicator head 11. In FIG. 1, it is pivoted toward edge 11*b*, making edge 11*a* the "leading edge," and edge 11*b* the "trailing edge," relative to the direction in which the device is pushed. If one were to pivot the handle toward edge 11*a*, edge 11*b* would become the leading edge and 11*a* the trailing edge.

The applicator head can be provided in a wide variety of sizes and shapes. For example, rectangular shaped applicator heads ranging from about 8 to about 30 inches in length and about 2 to about 8 inches wide are useful.

The cleaning device of the present invention is designed for attaching a cleaning element 18 which may be easily removed and replaced on the applicator head 11. With the hooks 14 positioned around the periphery of the holes 14 any lateral movement of the cleaning element relative to the applicator head is prevented.

One of the advantages of the design of the claimed invention is it can integrally molded by injection molding or the like of a thermoplastic employing a two piece mold. It is useful as a mop head and readily allows extra liquids to drain through the application head and into a cleaning element instead of splashing on the surface to be cleaned e.g. a floor.

What is claimed is:

1. A cleaning device comprising:

an applicator head having a top side and a bottom side and including holes there through which are sufficient in size and number that cleaning liquid collecting on said top side readily flows through the applicator head, but sufficiently small in size and number as to not unduly weaken said applicator head; and a plurality of spaced apart hooks positioned around the peripheral edge of each said holes, extending from said bottom side of said applicator head, and each said hook comprising a shaft with a barb extending from the end of said shaft said barb facing in and extending beneath its adjacent hole, there being a sufficient number of said hooks that a cleaning element can be releasable attached by said hooks to said applicator head.

2. The cleaning device of claim 1 in which said applicator head has a perimeter which includes a leading perimeter edge and a trailing perimeter edge; said holes being located at least along said leading and trailing edges of said applicator head.

3. The cleaning device of claim 2 in which said applicator head includes a central area between said holes located at said leading and trailing edges, said central area being substantially free of holes.

4. The cleaning device of claim 3 in which there is at least one reinforcing rib free of holes extending over said central area of said applicator head.

5. The cleaning device of claim 3 in which said holes and their associated hooks occupy from about 15 to about 50 percent of the area of said bottom side of said applicator head.

6. The cleaning device of claim 5 in which said area occupied by said holes and said hooks if from about 25 to about 30% percent of the area.

7. The cleaning device of claim 6 in which said holes and their associated hooks occupy about 80 to about 95 percent of the perimeter area of said applicator head.

8. The cleaning head of claim 2 in which said hooks are spaced from about 0.06 to about 0.35 inches apart.

9. The cleaning head of claim 8 in which said hooks are spaced from about 0.12 to about 0.25 inches apart.

10. The cleaning device of claim 2 in which said applicator head has parallel longitudinal edges defining said leading and trailing edges, and end edges connecting said longitudinal edges, said cleaning head including at least one of said holes adjacent each of said end edges.

11. The cleaning device of claim 2 in which the area of each said hole is in the range of from about 0.35 to about 0.60 square inches.

12. The cleaning device of claim 11 in which there are from 14 to 24 of said hooks around the perimeter of each said hole.

13. The cleaning device of claim 1 in which the area of each said hole is in the range of from about 0.35 to about 0.60 square inches.

14. The cleaning device of claim 1 in which there are from 14 to 24 of said hooks around the perimeter of each said hole.

15. The cleaning device of claim 1 in which said applicator head is integrally molded in a two piece mold.

16. A cleaning device comprising:

an applicator head having a top side and a bottom side and including holes there through which are sufficient in size and number that cleaning liquid collecting on said top side readily flows through the applicator head, but sufficiently small in size and number as to not unduly weaken said applicator head; and a plurality of spaced apart hooks positioned around the peripheral edge of each said holes, extending from said bottom side of said applicator head, and each said hook comprising a shaft with a barb extending from the end of said shaft said barb facing in and extending beneath its adjacent hole, there being a sufficient number of said hooks that a cleaning element can be releasable attached by said hooks to said applicator head; said applicator head having a perimeter which includes a leading perimeter edge and a trailing perimeter edge; said holes being located at least along said leading and trailing edges of said applicator head, wherein said holes are triangular, and are arranged in a single lattice row along both long sides of said applicator head in a flip flop orientation to each other, supported and defined by bridges between said holes.

17. The cleaning device of claim 16 in which said bridges between said adjacent triangular openings are oriented at an acute angle to the fore and aft direction of motion to which said applicator head would be moved, of from about 30-60 degrees.

18. The cleaning device of claim 17 in which said triangular shaped holes are equilateral in configuration, such that the acute angle of said bridges is about 45 degrees to the fore and aft direction of motion in which said applicator head would be moved.

19. A cleaning device comprising:

an applicator head having a top side and a bottom side and including holes there through which are sufficient in size and number that cleaning liquid collecting on said top side readily flows through the applicator head, but sufficiently small in size and number as to not unduly weaken said applicator head; and a plurality of spaced apart hooks positioned around the peripheral edge of each said holes, extending from said bottom side of said applicator head, and each said hook comprising a shaft with a barb extending from the end of said shaft said barb facing in and extending beneath its adjacent hole, there being a sufficient number of said hooks that a cleaning element can be releasable attached by said hooks to said applicator head; said applicator head having a perimeter which includes a leading perimeter edge and a trailing perimeter edge; said holes being located at least along said leading and trailing edges of said applicator head, wherein said holes are rectangular, and two rows of holes are provided along and extending away from said leading and trailing peripheral edges; said holes in said two rows being staggered relative to one another, so that solution will not tend to flow over said leading or trailing edges of said applicator head by passing between adjacent holes.

20. A cleaning device comprising:

an applicator head having a top side and a bottom side and including holes there through which are sufficient in size and number that cleaning liquid collecting on said top side readily flows through the applicator head, but sufficiently small in size and number as to not unduly weaken said applicator head; and a plurality of spaced apart hooks positioned around the peripheral edge of each said holes, extending from said bottom side of said applicator head, and each said hook comprising a shaft with a barb extending from the end of said shaft said barb facing in and extending beneath its adjacent hole, there being a sufficient number of said hooks that a cleaning element can be releasable attached by said hooks to said applicator head; said applicator head including a perimeter lip extending downwardly around the perimeter of said applicator head; the downward length of said lip is slightly greater than the length of said hooks which also extend downward, whereby said lip helps keep said cleaning element from shifting about as said cleaning device is used, thereby minimizing flexing stress on said hooks, and also protects said hooks from excessive impact, and provides reinforcing strength to applicator head.

21. The cleaning device of claim 20 in which:

said applicator head is integrally molded in a two piece mold, said applicator head having a perimeter which includes a leading perimeter edge and a trailing perimeter edge; said holes through said applicator head being located at least along said leading and trailing edges of said applicator head.

22. The cleaning device of claim 21 in which said applicator head includes a central area between said holes located at said leading and trailing edges, said central area being substantially free of holes.

23. The cleaning device of claim 22 in which said holes and their associated hooks occupy from about 15 to about 50 percent of the area of said bottom side of said applicator head; there being from about 14 to about 24 of said hooks around the perimeter of each said hole; the area of each said hole being from about 0.35 to about 0.60 square inches.

24. The cleaning device of claim 23 in which said holes and their associated hooks occupy about 80 to about 95 percent of the perimeter area of said applicator head.

25. The cleaning device of claim 23 in which said holes and their associated hooks occupy at least about 90 percent of the perimeter area of said applicator head.

26. A cleaning device comprising:

an applicator head which is integrally molded in a two piece mold, said applicator head having a top side and a bottom side and a perimeter which includes a leading perimeter edge and a trailing perimeter edge; said applicator head including holes there through located at least along said leading and trailing edges of said applicator head, said holes being sufficient in size and number that cleaning liquid collecting on said top side readily flows through the applicator head, but sufficiently small in size and number as to not unduly weaken said applicator head; and a plurality of spaced apart hooks positioned around the peripheral edge of each said holes, extending from said bottom side of said applicator head, and each said hook comprising a shaft with a barb extending from the end of said shaft said barb facing in and extending beneath its adjacent hole, there being a sufficient number of said hooks that a cleaning element can be releasable attached by said hooks to said applicator head.

27. The cleaning device of claim 26 in which said applicator head includes a central area between said holes located at said leading and trailing edges, said central area being substantially free of holes.

28. The cleaning device of claim 26 in which said holes and their associated hooks occupy from about 15 to about 50 percent of the area of said bottom side of said applicator head; there being from about 14 to about 24 of said hooks around the perimeter of each said hole; the area of each said hole being from about 0.35 to about 0.60 square inches.

29. The cleaning device of claim 28 in which said holes and their associated hooks occupy about 80 to about 95 percent of the perimeter area of said applicator head.

30. The cleaning device of claim 28 in which said holes and their associated hooks occupy at least about 90 percent of the perimeter area of said applicator head.

* * * * *